US011638088B2

(12) United States Patent
Matsushita et al.

(10) Patent No.: US 11,638,088 B2
(45) Date of Patent: Apr. 25, 2023

(54) SOUND COLLECTING DEVICE

(71) Applicant: HOSIDEN CORPORATION, Osaka (JP)

(72) Inventors: Tsutomu Matsushita, Fukuoka (JP); Hiroyuki Harano, Fukuoka (JP); Ryuji Awamura, Fukuoka (JP); Kensuke Nakanishi, Fukuoka (JP)

(73) Assignee: HOSIDEN CORPORATION, Osaka (JP)

( * ) Notice: Subject to any disclaimer, the term of this patent is extended or adjusted under 35 U.S.C. 154(b) by 91 days.

(21) Appl. No.: 17/238,555

(22) Filed: Apr. 23, 2021

(65) Prior Publication Data

US 2021/0345035 A1 Nov. 4, 2021

(30) Foreign Application Priority Data

Apr. 30, 2020 (JP) ..... JP2020-080040

(51) Int. Cl.
*H04R 1/34* (2006.01)
*H04R 1/46* (2006.01)
*H04R 17/02* (2006.01)

(52) U.S. Cl.
CPC ..... *H04R 1/342* (2013.01); *H04R 1/46* (2013.01); *H04R 17/02* (2013.01)

(58) Field of Classification Search
CPC ..... H04R 1/342; H04R 1/46; H04R 17/00; H04R 17/02; H04R 2231/003
USPC ..... 381/160, 173, 190, 114, 151, 162, 361, 381/375, 423
See application file for complete search history.

(56) References Cited

U.S. PATENT DOCUMENTS 4,591,668 A * 5/1986 Iwata ..... H04R 1/46 381/151
8,724,839 B2 5/2014 Harano
8,879,752 B2 11/2014 Harano et al.
10,999,684 B1 * 5/2021 Wan ..... H04R 17/02
(Continued)

FOREIGN PATENT DOCUMENTS

JP 2017-183853 A 10/2017
JP 6622638 B2 12/2019

OTHER PUBLICATIONS

Extended Search Report issued in European Patent Office (EPO) Patent Application No. 21170481.2, dated Sep. 27, 2021.

*Primary Examiner* — Norman Yu
(74) *Attorney, Agent, or Firm* — Greenblum & Bernstein, P.L.C.

(57) ABSTRACT

A sound collecting device that is located in a first space and collects sounds generated in a second space isolated from the first space by a predetermined plate, comprising a metal plate, a piezoelectric element fixed on an upper surface of the metal plate, a housing that has a tubular shape having opened upper and lower surfaces, and has an upper end surface adhesively attached to a lower surface of the metal plate and a lower end surface adhesively attached to the predetermined plate, and a vibration pickup terminal that is accommodated in the housing, and comprises a leg part adhesively attached to the lower surface of the metal plate, a shaft part extending downward from the leg part, and a tip part which is formed at a tip of the shaft part in the downward direction and comes into contact with the predetermined plate when the housing is adhesively attached to the predetermined plate.

5 Claims, 1 Drawing Sheet

(56) References Cited

U.S. PATENT DOCUMENTS

| | | | | |
|---|---|---|---|---|
| 2009/0052699 | A1* | 2/2009 | Andersen | H04R 17/02<br>156/256 |
| 2013/0094676 | A1 | 4/2013 | Muraoka | |

* cited by examiner

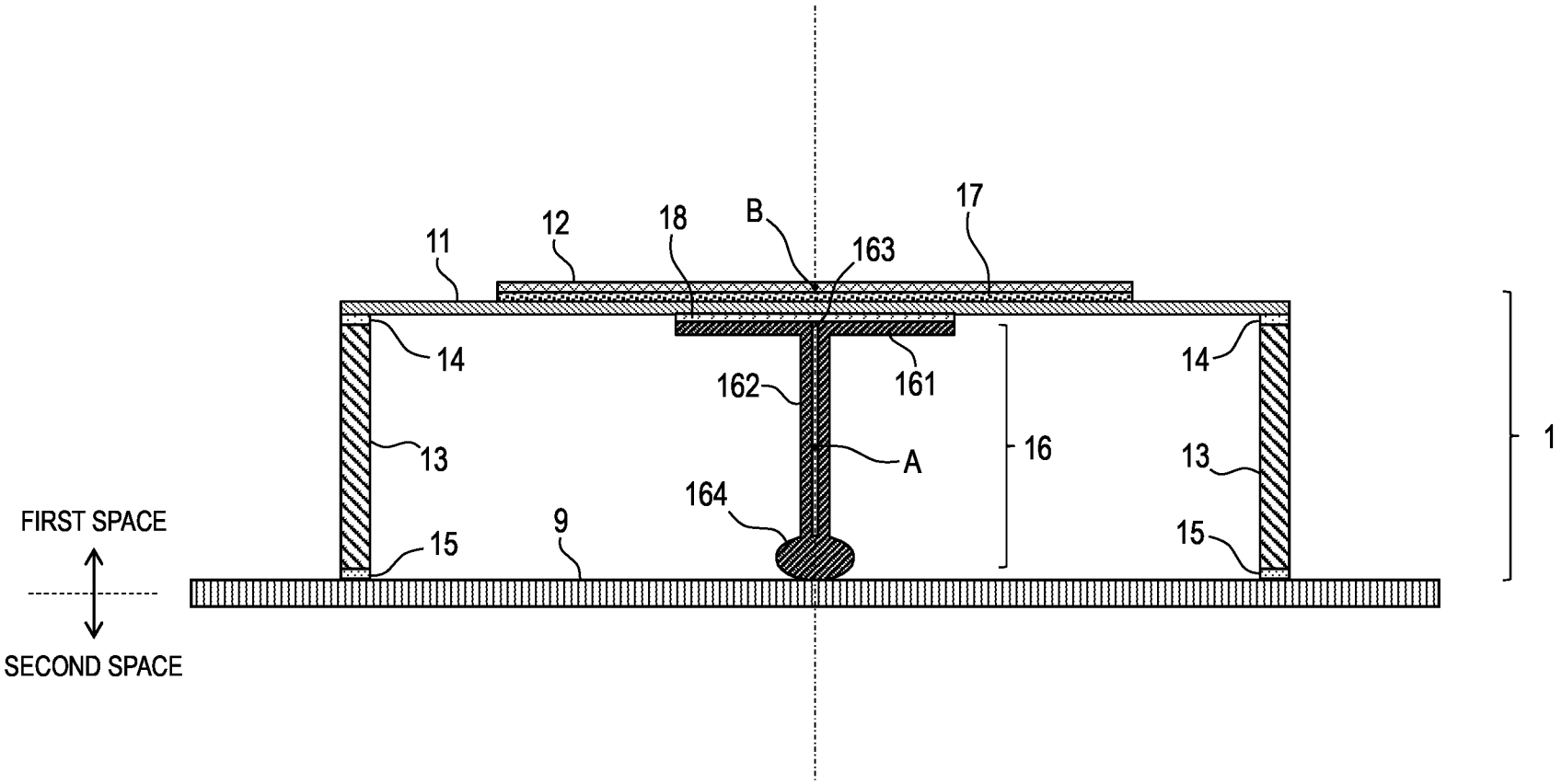
1
14
13
15
16
17
161
A
163
B
162
164
18
12
9
11
14
13
15
FIRST SPACE
SECOND SPACE

SOUND COLLECTING DEVICE

TECHNICAL FIELD

The present invention relates to a sound collecting device that is located in a first space and collects sounds generated in a second space isolated from the first space by a predetermined plate.

BACKGROUND ART

For example, Japanese Registered Patent No. 6622638 (hereinafter referred to as "Patent Literature 1") or the like is known as a prior art of a pickup microphone.

A contact microphone element disclosed in Patent Literature 1 is a contact microphone element that presses a piezoelectric element with a vibrating element to convert a mechanical vibration into an electric signal. The contact microphone element includes a piezoelectric vibrating plate that is supported in an element case so as to be capable of vibrating in the element case, and a vibrator that is accommodated in the element case and arranged above the piezoelectric vibrating plate. The vibrator has a spherical part which comes into contact with a center part of the piezoelectric vibrating plate, and an elastic member that is interposed at least between the piezoelectric vibrating plate and the spherical part of the vibrator in the element case.

For example, a sound hole is required in order to cause sounds generated outside a vehicle to be listened to inside the vehicle, but there are many cases where vehicles cannot be provided with sound holes due to various circumstances. Also, when a reception room and a waiting room of a hospital or the like are isolated from each other by glass or the like, a sound hole is also required when sounds generated in the waiting room are listened to in the reception room. However, from the viewpoint of hygiene, it may be impossible to provide a sound hole.

SUMMARY OF THE INVENTION

Therefore, an object of the present invention is to provide a sound collecting device that is located in a first space and can collect sounds generated in a second space isolated from the first space by a predetermined plate.

A sound collecting device according to the present invention is a sound collecting device that is located in a first space and collects sounds generated in a second space isolated from the first space by a predetermined plate, comprising: a metal plate; a piezoelectric element fixed on an upper surface of the metal plate; a housing that has a tubular shape having opened upper and lower surfaces, and has an upper end surface adhesively attached to a lower surface of the metal plate and a lower end surface adhesively attached to the predetermined plate; and a vibration pickup terminal that is accommodated in the housing, and comprises a leg part adhesively attached to the lower surface of the metal plate, a shaft part extending downward from the leg part, and a tip part which is formed at a tip of the shaft part in the downward direction and comes into contact with the predetermined plate when the housing is adhesively attached to the predetermined plate.

Effects of the Invention

The sound collecting device according to the present invention is located in a first space, and can collect sounds generated in a second space isolated from the first space by a predetermined plate.

BRIEF DESCRIPTION OF THE DRAWING

FIG. 1 is a cross-sectional view of a sound collecting device of a first embodiment.

DETAILED DESCRIPTION

Hereinafter, an embodiment of the present invention will be described in detail. Note that constituent parts having the same functions are designated by the same reference numbers, and duplicate description thereof will be omitted.

First Embodiment

Hereinafter, a configuration of a sound collecting device of a first embodiment will be described with reference to FIG. 1. As shown in FIG. 1, the sound collecting device 1 of the present embodiment is a sound collecting device that is located in a first space (for example, inside a vehicle, indoor), and collects sounds generated in a second space (for example, outside a vehicle, outdoor) isolated from the first space by a predetermined plate 9 (for example, a window glass of an automobile, a window glass of a room, a glass plate, an acrylic plate or the like through which a reception room and a waiting room are isolated from each other). The sound collecting device 1 comprises a metal plate 11 (functioning as a minus-side electrode), a piezoelectric element 12 fixed to the upper surface of the metal plate 11 via an adhesive layer 17, a housing 13 which has a tubular shape having opened upper and lower surfaces (for example, may have a cylindrical shape, a square tubular shape, or a tubular shape having an arbitrary polygonal shape in cross-section), and has an upper end surface adhesively attached to the lower surface of the metal plate 11 via an adhesive layer 14 and a lower end surface adhesively attached to the plate 9 via an adhesive layer 15, and a vibration pickup terminal 16 that is accommodated in the housing 13, and comprises a leg part 161 (for example, may be formed in a flat-disk shape) adhesively attached to the lower surface of the metal plate 11 via an adhesive layer 18, a shaft part 162 extending downward from the leg part 161, and a tip part 164 (for example, may be formed in a spherical shape or an elliptical shape collapsed in a vertical direction) which is formed at a tip of the shaft part 162 in the downward direction and comes into contact with the plate 9 when the housing 13 is adhesively attached to the plate 9.

It is desirable that the adhesive layers 14, 17 and 18 are realized with hard adhesives in order to reduce vibration loss. Note that since the adhesive layer 15 is not intended to transmit vibration, it is not necessary to use a hard adhesive, but an adhesive having a high adhesive force is suitable.

As shown in FIG. 1, by arranging a straight line (one-dotted chain line in FIG. 1) extending in a long axis direction from a center (point A in FIG. 1) of the vibration pickup terminal 16 so as to pass by a center (point B in FIG. 1) of the piezoelectric element 12, it is possible to efficiently transmit vibration propagating through the vibration pickup terminal 16 to the piezoelectric element 12.

As shown in FIG. 1, when the shaft part 162 is provided with a hole 163 extending in the long axis direction of the shaft part 162 to make the shaft part 162 hollow, this is suitable because sound waves propagating in the plate 9 can be efficiently transmitted to the piezoelectric element 12.

Further, when the vibration pickup terminal 16 is configured to have a pogo pin structure or a spring terminal in which a spring (not shown) is accommodated in a hollow of the shaft part 162, the upper end of the spring is connected to the leg part 161, and the lower end of the spring is connected to the tip part 164, this is suitable because the length of the vibration pickup terminal 16 can be automatically adjusted.

When the total length of the vibration pickup terminal 16 in the vertical direction is set to be larger than the total length of the housing 13 in the vertical direction by a predetermined length (for example, about several mm), this is suitable because the metal plate 11, the vibration pickup terminal 16, and the plate 9 are held in a state where pressure is always applied among the metal plate 11, the vibration pickup terminal 16 and the plate 9, so that the sensitivity to the sound waves propagating through the plate 9 can be enhanced.

For example, when a reception room and a waiting room of a hospital are isolated from each other by an acrylic plate or the like, the sound collecting device 1 of the present embodiment is attached to the acrylic plate on the reception room side (first space), whereby sounds generated in the waiting room (second space) can be accurately collected, and reproduced by a speaker installed on the reception room side. Therefore, it becomes possible to perform conversation and communication between a person in the reception room and a person in the waiting room. For example, the same effect can be obtained when a front seat and a rear seat (or a driver's seat and a passenger seat) of a taxi are isolated from each other by an acrylic plate or the like.

Further, for example, by attaching the sound collecting device 1 of the present embodiment to a window glass inside a vehicle (first space), sounds generated outside the vehicle (second space) can be accurately collected and reproduced by a speaker installed inside the vehicle. Therefore, it is possible to perform conversation and communication between a person inside the vehicle and a person outside the vehicle.

What is claimed is:

1. A sound collecting device that is located in a first space and collects sounds generated in a second space isolated from the first space by a predetermined plate, comprising:

a metal plate;

a piezoelectric element fixed on an upper surface of the metal plate;

a housing that has a tubular shape having opened upper and lower surfaces, and has an upper end surface adhesively attached to a lower surface of the metal plate and a lower end surface adhesively attached to the predetermined plate; and a vibration pickup terminal that is accommodated in the housing, and comprises a flat-disk-shaped leg part adhesively attached to the lower surface of the metal plate, a shaft part extending downward from the leg part, and a tip part which is formed at a tip of the shaft part in the downward direction and comes into contact with the predetermined plate when the housing is adhesively attached to the predetermined plate, the tip part having one of a spherical shape or an elliptical shape.

2. A sound collecting device that is located in a first space and collects sounds generated in a second space isolated from the first space by a predetermined plate, comprising:

a metal plate;

a piezoelectric element fixed on an upper surface of the metal plate;

a housing that has a tubular shape having opened upper and lower surfaces, and has an upper end surface adhesively attached to a lower surface of the metal plate and a lower end surface adhesively attached to the predetermined plate; and a vibration pickup terminal that is accommodated in the housing, and comprises a leg part adhesively attached to the lower surface of the metal plate, a hollow shaft part extending downward from the leg part, and a tip part which is formed at a tip of the shaft part in the downward direction and comes into contact with the predetermined plate when the housing is adhesively attached to the predetermined plate.

3. A sound collecting device that is located in a first space and collects sounds generated in a second space isolated from the first space by a predetermined plate, comprising:

a metal plate;

a piezoelectric element fixed on an upper surface of the metal plate;

a housing that has a tubular shape having opened upper and lower surfaces, and has an upper end surface adhesively attached to a lower surface of the metal plate and a lower end surface adhesively attached to the predetermined plate; and a vibration pickup terminal that is accommodated in the housing, and comprises a leg part adhesively attached to the lower surface of the metal plate, a hollow shaft part extending downward from the leg part, and a tip part which is formed at a tip of the shaft part in the downward direction and comes into contact with the predetermined plate when the housing is adhesively attached to the predetermined plate, wherein the vibration pickup terminal is configured to have a pogo pin structure in which a spring is accommodated in a hollow of the shaft part, an upper end of the spring is connected to the leg part, and a lower end of the spring is connected to the tip part.

4. A sound collecting device that is located in a first space and collects sounds generated in a second space isolated from the first space by a predetermined plate, comprising:

a metal plate;

a piezoelectric element fixed on an upper surface of the metal plate;

a housing that has a tubular shape having opened upper and lower surfaces, and has an upper end surface adhesively attached to a lower surface of the metal plate and a lower end surface adhesively attached to the predetermined plate; and a vibration pickup terminal that is accommodated in the housing, and comprises a leg part adhesively attached to the lower surface of the metal plate, a hollow shaft part extending downward from the leg part, and a tip part which is formed at a tip of the shaft part in the downward direction and comes into contact with the predetermined plate when the housing is adhesively attached to the predetermined plate, wherein the vibration pickup terminal is configured to have a pogo pin structure in which a spring is accommodated in a hollow of the shaft part, an upper end of the spring is connected to the leg part, and a lower end of the spring is connected to the tip part, and wherein a total length of the vibration pickup terminal in a vertical direction is set to be larger than a total length of the housing in the vertical direction by a predetermined length.

5. The sound collecting device according to claim 2, wherein the shaft part includes a hole extending in a longitudinal axis direction of the shaft part.

* * * * *